US008613312B2

(12) United States Patent
Zolezzi-Garreton

(10) Patent No.: US 8,613,312 B2
(45) Date of Patent: Dec. 24, 2013

(54) METHOD AND APPARATUS FOR STIMULATING WELLS

(75) Inventor: Alfredo Zolezzi-Garreton, Vina del Mar (CL)

(73) Assignee: Technological Research Ltd, Tortola (VG)

( * ) Notice: Subject to any disclaimer, the term of this patent is extended or adjusted under 35 U.S.C. 154(b) by 437 days.

(21) Appl. No.: 12/962,436

(22) Filed: Dec. 7, 2010

(65) Prior Publication Data

US 2011/0139440 A1 Jun. 16, 2011

Related U.S. Application Data

(60) Provisional application No. 61/285,541, filed on Dec. 11, 2009.

(51) Int. Cl.
*E21B 43/00* (2006.01)

(52) U.S. Cl.
USPC ..... 166/248; 166/249; 166/177.1; 166/177.2; 166/65.1; 181/206; 181/108; 181/113

(58) Field of Classification Search
USPC ..... 166/248, 249, 177.1, 177.2, 65.1; 181/106, 108, 113
See application file for complete search history.

(56) References Cited

U.S. PATENT DOCUMENTS

| | | | | |
|---|---|---|---|---|
| 3,648,769 | A | 3/1972 | Sawyer | |
| 3,721,297 | A | 3/1973 | Challacombe | |
| 3,758,731 | A * | 9/1973 | Vann et al. | 200/61.69 |
| 4,049,053 | A | 9/1977 | Fisher et al. | |
| 4,834,209 | A * | 5/1989 | Vogel et al. | 181/105 |
| 4,997,044 | A * | 3/1991 | Stack | 166/385 |
| 5,595,243 | A | 1/1997 | Maki, Jr. et al. | |
| 5,994,818 | A | 11/1999 | Abramov | |
| 6,230,799 | B1 | 5/2001 | Slaughter | |
| 6,279,653 | B1 | 8/2001 | Wegener et al. | |
| 6,405,796 | B1 | 6/2002 | Meyer | |
| 6,429,575 | B1 | 8/2002 | Abramov | |
| 6,776,256 | B2 | 8/2004 | Kostyuchenko | |

(Continued)

FOREIGN PATENT DOCUMENTS

| | | |
|---|---|---|
| RU | 2026969 | 1/1995 |
| RU | 2388908 | 5/2010 |
| RU | 2392422 C1 | 6/2010 |

OTHER PUBLICATIONS

Igor A. Beresnev, Elastic-wave Stimulation of Oil Production: A Review of Methods and Results, Jun. 1994, Geophysics, Vol. 59, No. 6 (Jun. 1994); p. 1000-1017, 15 Figs., 3 Tables—18 pages. Included.

(Continued)

*Primary Examiner* — Kenneth L Thompson
*Assistant Examiner* — Marwan Bashir
(74) *Attorney, Agent, or Firm* — Karim Lagobi

(57) ABSTRACT

The invention provides an apparatus and method for stimulating a borehole of a well. The invention provides an apparatus that generates low-frequency seismic type elastic waves that propagate to the geologic formation and in order to enhance the movement of fluids in the geologic formation toward a well. The apparatus may operate automatically driven by a power source that may be located on the ground surface. The regime of operation may be determined by user input. Operation of the apparatus may carried out while production of a natural resource is ongoing.

17 Claims, 7 Drawing Sheets

(56) References Cited

U.S. PATENT DOCUMENTS

| | | | | |
|---|---|---|---|---|
| 6,834,743 | B2 * | 12/2004 | Arian et al. | 181/102 |
| 6,899,175 | B2 | 5/2005 | Kostrov | |
| 7,063,144 | B2 | 6/2006 | Abramov | |
| 7,367,405 | B2 | 5/2008 | Murray | |
| 7,649,276 | B2 * | 1/2010 | Kornbluh et al. | 290/53 |
| 2009/0008082 | A1 | 1/2009 | Ellingsen | |

OTHER PUBLICATIONS

Brian Champion. SPE European Formation Damage Conference, May 13-14, 2003, The Hague, The Netherlands.

* cited by examiner

METHOD AND APPARATUS FOR STIMULATING WELLS

FIELD OF THE INVENTION

The invention relates to stimulating production of wells producing natural resources such as crude oil, gas, and/or water; in particular the invention relates to a method and apparatus for stimulating a geologic formation using a downhole tool to apply low-frequency mechanical waves.

A portion of the disclosure of this patent document contains material which is subject to copyright protection. The copyright owner has no objection to the facsimile reproduction by anyone of the patent document or the patent disclosure, as it appears in the Patent and Trademark Office file or records, but otherwise reserves all copyrights associated with this document.

BACKGROUND OF THE INVENTION

A major challenge with production of natural resources such as oil, gas and water from wells is that the productivity gradually decreases over time. While a decrease is expected to naturally accompanies the depletion of the reserves in the reservoir, often well before any significant depletion of the reserves, production diminishes as a result of factors that affect the geologic formation in the zone immediately surrounding the well and in the well's configuration itself. For example, Crude Oil production can decrease as a result of the reduction in permeability of the rock formation surrounding the well, a decrease of the fluidity of oil or the deposit of solids in the perforations leading to the collection zone of the well.

In production wells, perforations aid the fluid from the formation seeping through cracks or fissures in the formation to flow toward a collection compartment in the well. Hence, the pore size of the perforations connecting the well to the formation determines the flow rate of the fluid from the formation toward the well. Along with the flow of oil, gas or water, very small solid particles from the formation, called "fines," flow and often settle around and within the well, thus, reducing the pore size.

Solids such as clays, colloids, salts, paraffin etc. accumulate in perforation zones of the well. These solids reduce the absolute permeability, or interconnection between pores. Mineral particles may be deposited, inorganic scales may precipitate, paraffins, asphalt or bitumen may settle, clay may become hydrated, and solids from mud and brine from injections may invade the perforations. The latter problems lead to a flow restriction in the zone surrounding the perforations.

As a result of the reduction of productivity, of oil wells for example, the exploitation may become prohibitively expensive forcing abandonment of the wells.

Production wells of oil and gas, for instance, are periodically stimulated by applying three general types of treatment: mechanical, chemical, and other conventional techniques which include intensive rinsing, fracturing and acid treatment.

Chemical acid treatment consists of injecting in the production zone mixtures of acids, such as hydrochloric acid and hydrofluoric acid (HCl and HF). Acid is used for dissolving reactive components (e.g., carbonates, clay minerals, and in a smaller quantity, silicates) in the rock, thus increasing permeability. Additives, such as reaction retarding agents and solvents, are frequently added to the mixtures to improve acid performance in the acidizing operation.

While acid treatment is a common treatment to stimulate oil and gas wells, this treatment has multiple drawbacks.

Among the drawbacks of acid treatment are: 1) the cost of acids and the cost of disposing of production wastes are high; 2) acids are often incompatible with crude oil, and may produce viscous oily residues inside the well; precipitates formed once the acid is consumed can often be more obnoxious than dissolved minerals; and 3) the penetration depth of active or live acid is generally low (less than 5 inches or 12.7 cm).

Hydraulic fracturing is a mechanical treatment usually used for stimulating oil and gas wells. In this process, high hydraulic pressures are used to produce vertical fractures in the formation. Fractures can be filled with polymer plugs, or treated with acid (in rocks, carbonates, and soft rocks), to form permeability channels inside the wellbore region; these channels allow oil and gas to flow. However, the cost of hydraulic fracturing is extremely high (as much as 5 to 10 times higher than acid treatment costs). In some cases, fracture may extend inside areas where water is present, thus increasing the quantity of water produced (a significant drawback for oil extraction). Hydraulic fracture treatments extend several hundred meters from the well, and are used more frequently when rocks are of low permeability. The possibility of forming successful polymer plugs in all fractures is usually limited, and problems such as plugging of fractures and grinding of the plug may severely deteriorate productivity of hydraulic fractures.

Another method for improving oil production in wells involves injecting steam or water. One of the most common problems in depleted oil wells is precipitation of paraffin and asphaltenes or bitumen inside and around the well. Steam or water has been injected in these wells to melt and dissolve paraffin into the oil or petroleum, and then all the mixture flows to the surface. Frequently, organic solvents are used (such as xylene) to remove asphaltenes or bitumen whose melting point is high, and which are insoluble in alkanes. Steam and solvents are very costly (solvents more so than steam), particularly when marginal wells are treated, producing less than 10 oil barrels per day. The main limitation for use of steam and solvents is the absence of mechanical mixing, which is required for dissolving or maintaining paraffin, asphaltenes or bitumen in suspension.

Empirical evidence have shown that seismic type waves may have an important effect on oil reservoirs. For example, following seismic waves, either from earthquakes or artificial induction, there is a rise in the fluid levels (water or oil), yielding an increase in oil production. A report on these phenomena is published by I. A. Beresnev and P. A. Johnson (GEOPHYSICS, VOL. 59, NO. 6, JUNE 1994; P. 1000-1017), which is included in its entirety herewith by reference.

Several methods using sound waves to stimulate oil wells have been described. Challacombe (U.S. Pat. No. 3,721,297) describes a tool for cleaning wells using pressure pulses: a series of explosive and gas generator modules are interconnected in a chain, in such a manner that ignition of one of the explosives triggers the next one and a progression or sequence of explosions is produced. These explosions generate shock waves that clean the well. There are obvious disadvantages of this method, such as potential damages that can be caused to high-pressure oil and gas wells. Use of this method is not feasible because for additional dangers including fire and lack of control during treatment period.

Sawyer (U.S. Pat. No. 3,648,769) describes a hydraulically controlled diaphragm that produces "sinusoidal vibrations in the low acoustic range". Generated waves are of low intensity, and are not directed or focused to face the formation (rock). As a consequence, the major part of energy is propagated along the perforations.

Ultrasound techniques have been developed to increase production of crude oil from wells. However, there is a great amount of effects associated with exposing solids and fluids to an ultrasound field of certain frequencies and energy. In the case of fluids in particular, cavitation bubbles can be generated. These are bubbles of gas dissolved in liquid, or bubbles of the gaseous state of the same liquid (change of phase). Other associated phenomena are liquid degassing and cleaning of solid surfaces.

Maki Jr. et al. (U.S. Pat. No. 5,595,243) propose an acoustic device in which a piezoceramic transducer is set as radiator. The device presents difficulties in its manufacturing and use, because an asynchronous operation is required of a high number of piezoceramic radiators.

Vladimir Abramov et al., in "Device for Transferring Ultrasonic Energy to a Liquid or Pasty Medium" (U.S. Pat. No. 5,994,818) and in "Device for Transmitting Ultrasonic Energy to a Liquid or Pasty Medium" (U.S. Pat. No. 6,429,575), propose an apparatus consisting of an alternating current generator operating within the range of 1 to 100 kHz to transmit ultrasonic energy, and a piezoceramic or magnetostrictive transducer emitting ultrasound waves, which are transformed by a tubular resonator or wave guide system (or sonotrode) in transverse oscillations that contact the irradiated liquid or pasty medium. However, these patents are conceived to be used in containers of very large dimensions, at least as compared with the size and geometry of perforations present in wells. This shows limitations from a dimensional point of view, and also for transmission mode if it is desired to enhance production capacities of oil wells.

Julie C. Slaughter et al., in "Ultrasound Radiator of Dowhole Type and Method for Using It" (In U.S. Pat. No. 6,230,788), propose a device that uses ultrasonic transducers manufactured of Terfenol-D alloy and placed at the well bottom, and fed by an ultrasonic generator located at the surface. Location of transducers, axially to the device, allows the emission along a transverse direction. This invention proposes a viscosity reduction of hydrocarbons contained in the well through emulsification, when reacting with an alkaline solution injected to the well. This device considers a forced shallow circulation of fluid as a refrigeration system, to warrant continuity of irradiation.

Dennos C. Wegener et al., in "Heavy Oil Viscosity Reduction and Production," (U.S. Pat. No. 6,279,653), describe a method and a device for producing heavy oil (API specific gravity less than 20) applying ultrasound generated by a transducer made of Terfenol alloy, attached to a conventional extraction pump, and powered by a generator installed at the surface. In this invention the presence of an alkaline solution is also considered, similar to an aqueous sodium hydroxide (NaOH) solution, to generate an emulsion with crude oil of lower density and viscosity, thereby facilitating recovery of the crude by impulsion with a pump. Here, a transducer is installed in an axial position to produce longitudinal ultrasound emissions. The transducer is connected to an adjacent rod that operates as a wave guide or sonotrode.

Robert J. Meyer et al., in "Method for improving Oil Recovery Using an Ultrasonic Technique" (U.S. Pat. No. 6,405,796), propose a method to recover oil using an ultrasound technique. The proposed method consists of disintegrating agglomerates by means of an ultrasonic irradiation technique, and the operation is proposed within a certain frequency range, for the purpose of handling fluids and solids in different conditions. Main oil recovery mechanism is based in the relative momentum of these components within the device.

The latter mentioned prior art generates ultrasonic waves via a transducer that is externally supplied by an electric generator connected to the transducer through a transmission cable. The transmission cable is generally longer than 2 km, which has the disadvantage of signal transmission loss. Since high-frequency electric current transmission to such depths is reduced to 10% of its initial value, the generated signal must have a high intensity (or energy), enough for an adequate operation of the transducers within the well. Furthermore, since the transducers need to operate at a high-power regime, water or air cooling system is required, which in turn poses great difficulties when placed inside the well. The latter implies that ultrasound intensity must not exceed 0.5-0.6 W/cm2. This level is insufficient for the desired purposes, because threshold of acoustic effects in oil and rocks is from 0.8 to 1 W/cm2.

Andrey a. Pechkov, in "Method for Acoustic Stimulation of Wellbore Bottom Zone for Production Formation" (RU Patent No. 2 026 969), disclose methods and devices for stimulating production of fluids within a producing well. These devices incorporate, as an innovating element, an electric generator attached to the transducer, and both of them integrated in the well bottom. These transducers operate in a non-continuous mode, and can operate without needing an external cooling system. The impossibility of operating in a continuous mode to prevent overheating is one of the main drawbacks of this implementation since the availability of the device is reduced. Moreover, because the generator is located in the wellbottom, and especially because of the use of high power, the failure rate of the equipment is likely to be high, thus raising the cost of maintenance.

Oleg Abramov et al., in "Acoustic Method for Recovery of Wells, and Apparatus for its Implementation" (U.S. Pat. No. 7,063,144), disclosure an electro-acoustic method for stimulation of production within an oil well. The method consists of stimulating, by powerful ultrasound waves, the well extraction zone, causing an increase of mass transfer through its walls. This ultrasonic field produces large tension and pressure waves in the formation, thus facilitating the passage of liquids through well recovery orifices. It also prevents accumulation of "fines" on these holes, thereby increasing the life of the well and its extraction capacity.

Kostyuchenko in "Method and apparatus for generating seismic waves" (U.S. Pat. No. 6,776,256) generates seismic waves in an oil reservoir for well stimulation by chemical detonation. A packer is lowered into the well, where a fuel and air mixture is injected, and then detonated, generating seismic waves that reach the well walls. Some problems may appear considering possible unwanted explosions and difficulties regarding the transportation of a fuel and air mixture deep into the well.

Kostrov in "Method and apparatus for seismic stimulation of fluid bearing formations" (U.S. Pat. No. 6,899,175) describe another device for seismic waves generation. Shock waves are generated when compressed liquid is discharged to the well casing, forming seismic waves in the well borehole. This device has a limited range of applications as it may be only used in injection wells.

Ellingsen in "Sound source for stimulation of oil reservoirs" (US patent application publication 2009/0008082) a seismic wave generator is presented. Pressurized gas from a compressor located on the surface is transported into the wellbore where it operates a sound source that emits the seismic waves. The main limitation of this device is that it cannot operate over 1 kHz.

Murray in "Electric pressure actuating tool and method" (U.S. Pat. No. 7,367,405) describes using a tool to stimulate a down-hole using mechanical waves. This tool comprises a housing having a chamber filled with liquid, where an electrical discharge is produced. The discharge vaporizes the liquid creating a shock wave that pushes a piston, thus generating a pressure wave in the surrounding fluid. However, the presence of moving parts in the down hole may present difficulties, for instance, to provide required maintenance.

In "The application of high-power sound waves for wellbore cleaning", Champion et al., analyze techniques related to high power sound waves used in well stimulation, and indicate that a variety of techniques exists for the generation of sound waves, with one of the most common laboratory methods comprising the use of either piezoelectric or magnetostrictive type transducers. The piezoelectric devices employ a crystal that oscillates in response to an applied oscillating voltage, while the magnetostrictive devices employ an alloy that changes shape in the presence of a magnetic field and, creates a powerful force. In both cases, this study indicates that, the oscillatory movement generated is used to drive an acoustic transmitter element. The average power level of these devices is in the region of 0.5 watts/cm2, and the potential to increase this significantly is limited because of the presence of gas bubbles released by the periodic pressure oscillations within the fluid. Instead of this method based on transducers Champion et al. proposes the generation of high power sound waves by initiating a high voltage electrical discharge in a liquid medium—the electrolyte. This concept of sound wave generation has been practiced previously in the development and application of marine and downhole seismic "sparker" sources.

A high-energy electrical discharge, which may be of the order or several hundred joules, is triggered at a spark gap submerged in an electrolyte. Typical electrical-breakdown times in water can be engineered to occur in the nanosecond time scale. A high current flows from the anode to cathode, which causes the electrolyte adjacent to the spark gap to vaporize and form a rapidly expanding plasma gas bubble. After the discharge stops, the bubble continues to expand until its diameter increases beyond the limit sustainable by surface tension, at which point it will rapidly collapse (cavitation mechanism), producing the shock wave that propagates through the fluid and is used for wellbore cleaning. Previous work in the field has demonstrated that the creation of this transient acoustic shock wave, in the form of a pressure step function, has the potential to generate high power ultrasound with an intensity of greater than 50 watt/cm$^2$.

Sidney Fisher and Charles Fisher in "Recovery of hydrocarbons from partially exhausted oil wells by mechanical wave heating" (U.S. Pat. No. 4,049,053) describe heating underground viscous hydrocarbon deposits, such as the viscous residues in conventional oil wells, by mechanical wave energy to fluidize the hydrocarbons thereby to facilitate extraction thereof. The latter invention comprises a system for generating mechanical waves located on the ground surface transmitting the waves to the bottom of the well.

Therefore, what is needed is a method and system for improving well productivity that do not present, or at least that minimize, the above-mentioned drawbacks of each respective prior art.

SUMMARY OF THE INVENTION

The invention is a method and apparatus for stimulating wells of natural resources such as oil gas and water. The invention provides an apparatus enabled with one or more elastic wave generators and a power supplier.

An apparatus embodying the invention comprises a device capable of generating low-frequency acoustic waves. Such a device may produce low-frequency elastic waves by means of an electrical discharge in a liquid confined in a radiating chamber. Furthermore, the apparatus does not require to be removed between treatment and may be left in the well while production is ongoing in order to collect valuable information.

An apparatus embodying the invention provides short duration pulse discharges in a controlled environment inside a radiating chamber in order to generate seismic type waves. The energy storage device may be located in the well and may be driven by means of a power source located at the surface. When the required energy levels are reached the energy is pulse-discharged from the energy storage device into the radiating chamber, resulting in shock waves that are transmitted to the chamber surface and into the geologic formation.

By combining one or several acoustic modules, the system embodying the invention may be adapted to treat a large number of different types of wells, depending on a set of parameters that characterize each particular well and/or geologic formation. The components are modular and may be combined for any particular use. The apparatus comprises at least one low frequency and high power electro-acoustic module. Low attenuation of low frequency mechanical waves allows the waves to travel large distances. This configuration is intended for long-range applications in reservoirs. The latter device configuration allows for reservoir acoustic treatment at extremely deep depths (5000 to 15000 meters), and also at shallow depths. The low frequency regime may be operated in-phase mode as the energy pulse discharge can be done in phase with the radiating chamber deformation. In addition, the low-frequency module may be involved in applications that utilize seismic wave reflections to map underground geologic structures.

One or more embodiments of the invention deliver an acoustic device for oil, gas, and/or water wells, which does not require injection of chemicals for their stimulation. One of the advantages of the invention is that the system delivers an acoustic device for downhole that has no environmental treatment costs associated with returning the liquids to the well after their treatment.

An acoustical device is provided for the perforation zone (downhole) that can operate inside a tube without needing the withdrawal or elimination of said tube. In accordance with the invention, the device is able to operate within the tubing, at the end of the tubing using a coupling adapter to attach the device to the end of the tubing, and/or one or more stimulation devices may be mounted in a series with the tubing. In the latter case, a stimulation device may be interposed with the tubing i.e. the device is attached to the end of tubing and another tubing segment is attached to the second end of the stimulation device. The process may be repeated to install several stimulation devices.

DETAILED DESCRIPTION OF THE INVENTION

The invention provides a method and apparatus for stimulating oil, gas or water wells using a high-power electric discharge within a device embodying the invention in order to generate low-frequency mechanical waves. Furthermore, a device embodying the invention may be configured with one or more sensors to enable the system to collect a plurality of real-time information data that is processed and analyzed for further optimization of well stimulation.

In the following description, numerous specific details are set forth to provide a more thorough description of the invention. It will be apparent, however, to one skilled in the pertinent art, that the invention may be practiced without these specific details. In other instances, well known features have not been described in detail so as not to obscure the invention. The claims following this description are what define the metes and bounds of the invention.

Figure 1:
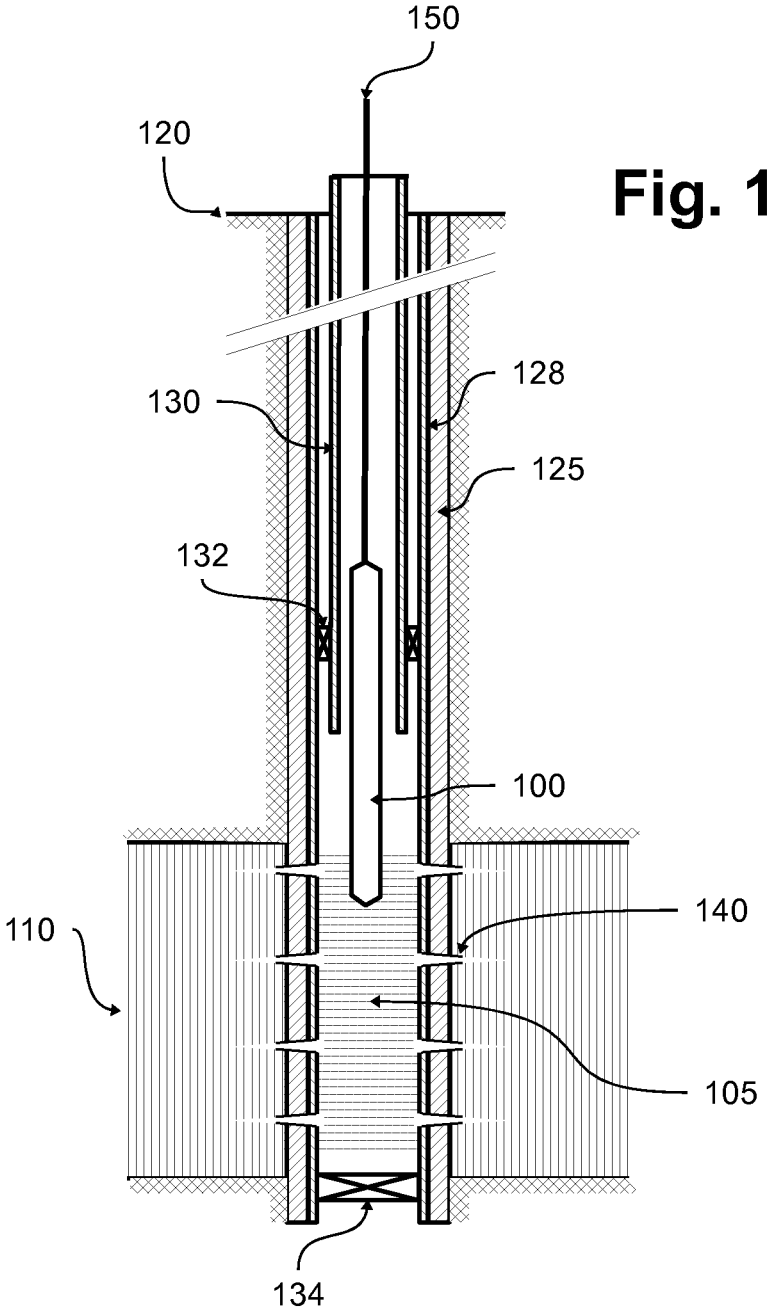
FIG. 1 shows a schematic representation of a typical well for extracting oil and/or gas, aiming at presenting the context in which an embodiment of the invention is utilized.

FIG. 1 shows a schematic representation of a typical well for extracting oil and/or gas, aiming at presenting the context in which an embodiment of the invention is utilized. Well 120, for extracting fluids from a geological formation, is basically a hole lined with a cement layer 125 and a casing 128 that houses and supports a production tube string 130 coaxially installed in its interior. Perforations (e.g., 140) in the well lining, provide a path or trajectory that allow fluids produced in the reservoir 110 to flow from the reservoir 110 toward the collection area of the well 105.

Typically, there are numerous perforations (e.g., 140) that extend radially from the lined or coated well. Perforations are uniformly separated in the lining, and pass to the outside of the lining through the formation. In an ideal case, perforations are only located within the formation, and their number depends on the formation thickness. It is rather common to have nine (9), and up to twelve (12) perforations per depth meter of formation. Other perforations extend longitudinally, and yet other perforations may extend radially from a 0°-azimuth, while additional perforations, located every 90° may define four sets of perforations around azimuth. Formation fluids pass through these perforations and come into the lined (or coated) well.

Preferably, the oil well is plugged by a sealing mechanism, such as a shutter element (e.g., 132), and/or with a bridge-type plug, located below the level of perforations (e.g., 134). The shutter element 132 may be connected to a production tube, and defines a compartment 105. The production fluid, coming from the formation or reservoir, enters the compartment and fills the compartment until it reaches a fluid level. Accumulated oil, for example, flows from the formation and can be accompanied by variable quantities of natural gas. Hence, the lined compartment 105 may contain oil, some water, natural gas, and solid residues, with normally, sand sewing at the bottom of the compartment.

A tool 100 for stimulating the well in accordance with embodiments of the invention, may be lowered into the well to reach any level of the formation that is selected to be subjected to mechanical wave treatment. The tool may be connected to the ground surface through an attachment means 150, attached to the extremity of the tube 130 using an adapter coupling, and/or interposed with the tubing. In the latter case, one or more stimulation devices may be mounted in a daisy chain manner, where one or more stimulation devices are mounted in series with segments of the tubing. Thus, a tool 100 may be lowered momentarily into a well for well treatment or by attaching the tool to the end of the tube 130, the tool may be operated even as the production continues from the well. The attachment means comprise a set of cables for providing the strength for holding the weight of tool 100. The attachment means may also comprise power cables for transmitting electrical energy to the tool, and communication cables such as copper wires and/or fiber optics for providing a means of transmitting data between control computers on the ground and the tool.

Figure 2:
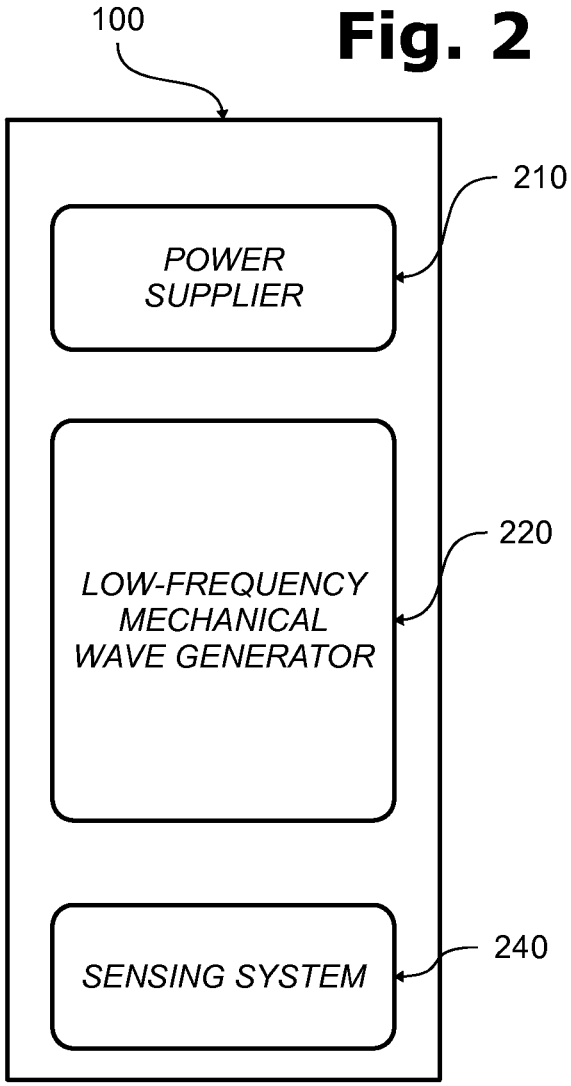
FIG. 2 is a block diagram representing components (or modules) of a tool for stimulating wells in accordance with an embodiment of the invention.

FIG. 2 is a block diagram representing components (or modules) of a tool for stimulating wells in accordance with an embodiment of the invention. A tool 100 comprises one or more acoustic wave generators. The acoustic wave generator 220 may be powered by a power supplier that may be hosted (210 as shown in FIG. 2) within the tool or may be located outside of the tool, such for example, on the ground surface. Tool 100 optionally comprises a sensing system 240. These modules may be mounted in a chain in any number, combination and sequence.

The invention provides a manager with the flexibility to adapt the tool to specific needs for stimulating a well. A tool 100 may combine any number of modules. The type, number and configuration of the modules depend on the goal a well manager may desire to achieve through the stimulation of the well. For example, a tool 100 allows a well manager, after studying the composition of the formation, the flow rate of the liquid, pressure, temperature and any other parameter of the well, to configure tool 100 for a target purpose. The target purpose may be to induce vibration in the rock at a greater distance (e.g., several meters from the well), in which case the manager may choose to use one or more low-frequency wave generators.

Power supplier 210 may be located with tool 100, outside of the tool 100 (e.g., as an attachment), on the ground surface or any other location that may be selected for optimal operation.

Power supplier 210 is comprised of an electric system capable of receiving power (e.g., direct-current power and or alternative current, AC) from the ground surface through a power transfer cable. The power supplier module is capable of transforming the power in accordance with requirement of the other components, such as the low-frequency mechanical wave generator 220, and delivering power to other component such as a set of sensors and data collection and transmission modules. In transforming power, power supplier 210 may convert direct current (DC) to alternative current or vice versa (AC); generate AC currents at one or several frequencies; generate pulsed currents or any type of electric power regime that may be necessary for the proper functioning of any of the component of tool 100. To the latter end, power supplier 210 comprises one or more electronic circuits to provide the correct electric current to components 220 in the tool. For example, tool 100 may comprise an electronic circuit for storing energy in a capacitor and delivering a high-voltage pulse when the energy stored in the capacitor reaches a predetermined threshold. The latter is useful, for example, for driving a low-frequency wave generator that utilizes a high-voltage current to generate an electric arc within a radiating chamber, thus, generating elastic waves.

In implementations of the invention where the power supplier is located on the ground surface, high power electric pulse signals are sent through geophysical cables to the downhole tool.

Power supplier 210 may also comprise electronic circuits enabling it to receive information and execute commands from a computer and/or another electronic circuit. For example, power supplier 210 may receive an instruction from a ground computer to start, stop or resume the operation of any component. It may receive instructions to deliver more or less power to any of the components or change the frequency of operation of one or more wave generators.

Embodiments of the invention comprise one or more low-frequency wave generators 220. Low-frequency sound waves are characterized by their ability to transfer energy over long distances (e.g., hundreds of meters). Embodiments of the invention may utilize any available device capable of generating elastic waves of low frequency (e.g., 1 to 100 Hz).

Embodiments of the invention utilize, in particular, a low-frequency wave generator that is based on the principal of creating an electric arc, which may be configured to emit powerful sound waves. A detailed description of a low-frequency mechanical wave generator in accordance with the invention is given further below in the disclosure.

The low frequency stimulation of the formation allows fluids whose move has slowed down to increase their movement towards the well. Fluid found in a formation is a colloidal system, as a solid phase is found in the fluid. This gives rise to a non-Newtonian fluid, which behaves as a solid or may have extremely high viscosity in certain conditions. Formation fluid affects the near-wellbore region by blocking the flow through the pores, and decreasing the permeability of the zone. This process is known as formation damage.

A tool embodying the invention (e.g., 100) may comprise a sensing system 240. A sensing system comprises one or more sensors designed to capture physical parameters such as temperature, pressure, gas content and any other physical manifestation relevant to oil recovery and well management. Sensors are chosen for the task based on their industrial design to withstand the stress of the elements in the operating environment. For example, sensors must be designed to withstand the corrosive environment under which operations are conducted.

A sensing system 240 in accordance with implementations of the invention, may comprise a set of transducers for converting physical information into digital information for transmission to a remote computer.

Figure 3:
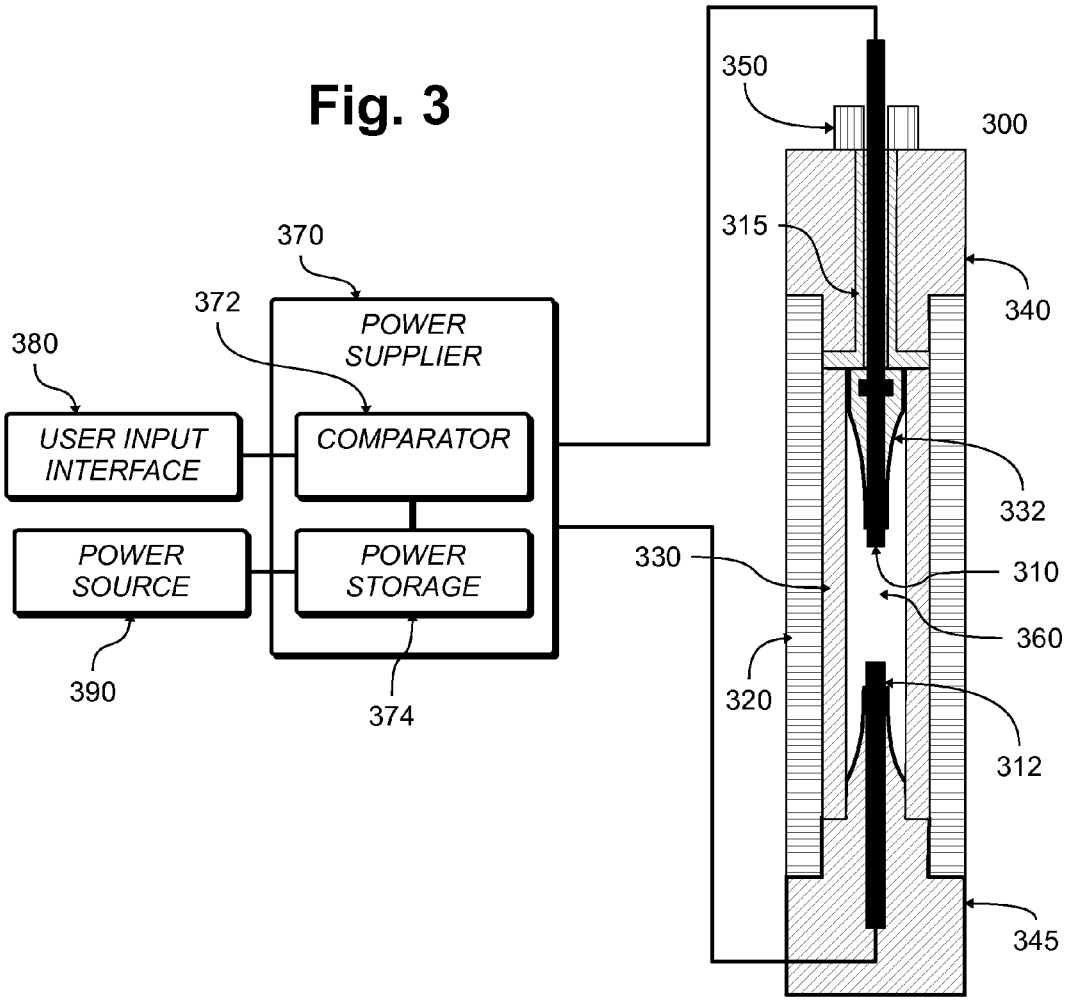
FIG. 3 schematically depicts parts of a low-frequency mechanical wave generator and a power supplier to drive the low-frequency mechanical waves generator in accordance with an embodiment of the invention.

FIG. 3 schematically depicts parts of a low-frequency mechanical wave generator and a power supplier to drive the low-frequency mechanical waves generator in accordance with an embodiment of the invention. The low-frequency mechanical wave generator of FIG. 3 comprises a radiation chamber 360 where high energy short duration pulse discharges are performed in a controlled environment inside the chamber.

The low-frequency mechanical wave generator 300 may be constructed using an outside casing 320, two or more lids (e.g., 340 and 345), a first and a second electrodes 310 and 312, respectively, a rubber interior coating 330, insulating sleeves 315 (e.g., Teflon sleeves) and rubber flanges (e.g., 350). The chamber 360 within which the electrodes protrude may be filled with a fluid. In some application the fluid in chamber 360 may be more or less electrically conducting depending on the desired application.

The low frequency mechanical wave generator 300 comprises a wave deflector 332. The wave deflector 332 may be any surface, such a parabolic-shaped surface, capable of deflecting and/or reflecting the acoustic wave. In embodiments of the invention, one or more deflectors are utilized to change the direction of part or the entire wave. For example, from an initial wave that may have a spherical shape, the reflection off of a parabolic surface may direct as much of the acoustic power in the wave perpendicularly to longitudinal axis of tool 300 as possible to maximize the amount of energy propagated inside the formation.

Casing 320 may be constructed using a corrosion-resistant metal or any other material that provides necessary strength, resistance to corrosion and other physical properties such as electric and heat conductance, density or any other property that would be relevant for any given application. It is noteworthy that the casing's material's physical properties are relevant because the shape and size of the casing may determine relevant vibration properties of the tool. For example, low-frequency mechanical waves generator may be designed to have a given desired resonance frequency.

The low-frequency mechanical waves generator 300 comprises an energy storage device that is charged by means of a power source. When the required energy levels for breaking the electric breakdown voltage of the non-conductive fluid inside the radiation chamber 360 are reached, all the energy is pulse-discharged from the energy storage device into the fluid. The latter results in an explosion inside chamber 360, creating shock waves.

In embodiments of the invention, the interior of chamber 360 may be carved to provide one or more surfaces that reflect pressure waves in such a manner that the waves can be focused and/or propagated in a specific direction. For example, shape feature 332 may be a parabolically-shaped surface the reflection on which would transform a spherical pressure wave emanating from the inter-electrode space into a radial pressure wave that propagates perpendicularly to the axis of tool 300.

Low-frequency mechanical waves are generated due to the excitation regime of the pulse discharges of the energy storage system. A system embodying the invention comprises a radiating chamber the length of which may be half the wave length ($\lambda/2$, where "$\lambda$" symbolizes the wave length) or an integer multiple of the wavelength of the electro-acoustic vibration. The wavelength depends on the speed of pressure wave in the material chosen for the construction of the chamber. For example, using stainless steal which has an approximate conductivity of sound waves of 5000-6000 m/s, the chamber would possess a wavelength of between 2.5 m and 12.5 cm for a resonance frequency of 1 kHz to 20 kHz.

In embodiments of the invention, in order to increase transmission of the electro-acoustic power, chamber 360 may be filled with a conductive fluid (e.g., calcium chloride dissolved in water). Electrodes may also be positioned at a specific distance to break the electrical breakdown voltage of the liquid. An electric discharge regimen may be established for the low frequency radiation (e.g. for low frequency oil/gas or water reservoir stimulation 0.1 Hz to 1000 Hz is recommended, which results in wavelengths of between 1 meter and 3000 meters). Said regimen is achieved by means of charging and discharging the energy storage device (e.g., using a high voltage low impedance capacitor).

An embodiment of the invention provides a corrosion-resistant heatsink chamber capable of being used as an acoustic resonance chamber. The disposition of the chamber in relation to other wave generators attributes to the device its resonance characteristics. The corrosion-resistant heatsink chamber also prevents the system from overheating by means of a heat-sink liquid which fills the device, allowing the system to work in gas reservoirs or oil wells with high concentration of gas. When working in heavy oil wells, the capacity to efficiently transfer the heat generated by the wave radiators to the environment also improves the capacity of the system to reduce the viscosity of the crude, thus facilitating crude oil extraction.

In a device embodying the invention comprising a low-frequency electro-acoustic radiating module, the chamber may be made of corrosion-resistant rubber 330 (e.g. rubber wrapped in Teflon) the length of which may be half the wavelength ($\lambda/2$), or an integer multiple of the wavelength ($\lambda$).

An embodiment according to FIG. 3, where the material inside the corrosion-resistant radiating chamber is a non conductive material (e.g. air). The energy needed in the energy storage device must reach the necessary levels for achieving the electric breakdown voltage in the gap between the electrodes. When such levels are reached, a pulse discharge of the energy stored in the energy storage device will be performed in the gap between the electrodes creating the shock wave of the elastic wave.

In embodiments of the invention the device comprises an adapter (not shown) that connects the low-frequency wave generator to the well's casing. In the latter embodiment low frequency is radiated to the reservoir through the natural resonance frequency of the well's casing. For instance, the natural resonance frequency of steel casing of a 2.5 km well is 1 Hz, considering a sound speed of 5000 m/s in steel from which said casing is typically made. As an added benefit, a device embodying the invention may be used in abandoned wells (within a reservoir) that may be dedicated to stimulating the reservoir with high-power low-frequencies, without concern for damage to the cement walls of those wells.

Embodiments of the invention provide a power supplier 370 for powering the mechanical waves generating device 300. Power supplier comprises a comparator 372 and at least one power storage unit 274. Comparator 372 is capable of receiving user input from a user interface 380. For example, a user may use the user interface 380 to set a threshold for triggering power transmission into the electrodes 310 and 312. Power supplier 370 comprises one or more power storage means 374. The power storage means are any electric device, such as a capacitor, capable of storing an electric charge. The latter is preferably a high capacity electric charge storage that is once charged can be discharged as a high-voltage pulse into the electrodes, thus causing an arc discharge i.e. explosion. Power supplier 370 may be powered by a power source 390. The power source comprises one or more electric devices for transmitting, transforming and converting electric power.

Figure 4A:
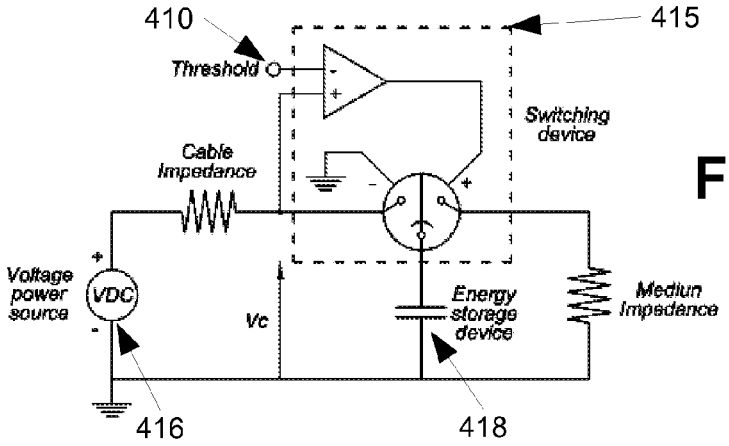
FIG. 4A schematically represents an electronic circuit for providing a high voltage electric discharge in accordance with an embodiments of the invention.

FIG. 4A schematically represents an electronic circuit for providing a high voltage electric discharge in accordance with an embodiment of the invention. An electronic circuit in accordance with the invention comprises means (e.g. 416) for receiving electric power from a power source. When implemented in a downhole tool (e.g., 100 above), power may be provided to the electronic circuit through a power cable. The means for receiving electric power may comprise one or more device for adapting and converting power. For example, the circuit may comprise one or more voltage and/or electric current transformers, regulators, AC/DC converters or any other electric device for involved in implementing the invention for a specific application.

An electronic circuit in accordance with the invention comprises a switching devices (e.g., 415) which triggers a high energy pulse discharge of the power stored in a storage device (e.g., 418) through the electrodes inside the radiating chamber. The switching device is enabled with means to receive power input and threshold means 410 to receive a power threshold value. The switching device (e.g., 415) may compare the voltage accumulated in the power storage device, such as a capacitor 418, with a user-defined discharge threshold (e.g., received on input 410). The capacitor may be in a charging mode while the voltage is below the predetermined level i.e. the discharge threshold. When the discharge threshold is reached, the switch commutates by means of an automatic switching device and the discharge process begins. Once a lower threshold is reached the switch commutates again and the charging process may restart. For example, an operational amplifier set up as a comparator and a relay may be used to construct the switching device. Thus, a device embodying the invention may be set to continuously deliver acoustic waves to a well without requiring manual operation by a user.

In embodiments of the invention a switching device comprises a timer (e.g., an electronic programmable timer). In the latter case, the switching device may utilize the signals from the timer to determine the periodicity for triggering pulse discharges.

Figure 4B:
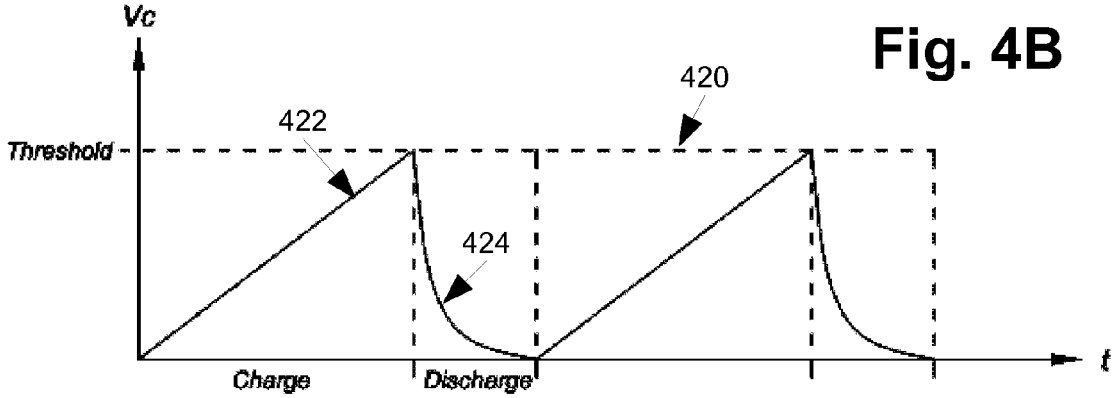
FIG. 4B and FIG. 4C are plots of the output voltage of electronic circuits as a function of time in accordance with embodiments of the invention.
Figure 4C:
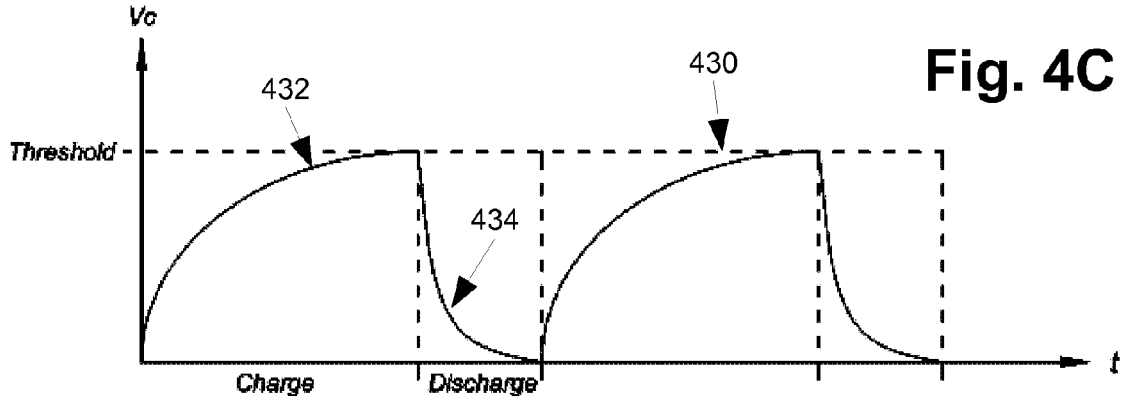

FIG. 4B and FIG. 4C are plots of the output voltage of electronic circuits as a function of time in accordance with embodiments of the invention. In the instance illustrated in FIG. 4B, the energy storage device is supplied with a fixed current power source, whereas FIG. 4C shows a plot of the voltage as a function of time when the energy storage device is supplied with a voltage power source. The voltage of the power storage (e.g., the capacitor) rises 432 while the voltage is below a predetermined threshold. Once the voltage reaches a threshold voltage, the power is discharged 434 through the electrodes in the discharge chamber.

The voltage charging ratio over time is the value of the current over the capacitance of the capacitor.

$$m = \frac{i}{C}$$

Where i is the current and C is the capacitor's capacitance. The necessary charging time for achieving a desired voltage $V_0$ with a constant current source is $$t = \frac{V_0 C}{i}$$

Plots 420 and 430 show voltage as a function time where the discharge frequency of the energy storage device is controlled by means of a voltage power source in accordance with an embodiment of the invention. In the latter configuration, the voltage charging time depends on the constant RC, where C is the capacitor's capacitance and R is the resistance of the cable from the generator to the capacitor. And the necessary time to charge the capacitor to a certain voltage using a constant voltage source is given by $$t = -RC \cdot \ln\left(1 - \frac{x}{100}\right);$$

$$0 \le x \le 100$$

Where x represents the relation (percentage) between the charging voltage and discharge threshold voltage.

An electronic circuit in accordance with embodiments of the invention may be configure to provide one or more profiles and timings for the successive charging phases (e.g., 422 and 432) and discharges (e.g., 424 and 434), the succession of which determine an inter-pulse discharge time interval. Therefore, by adjusting the threshold and the capacity of capacitor, the power and/or the frequency of the discharges may be controlled.

Figure 5:
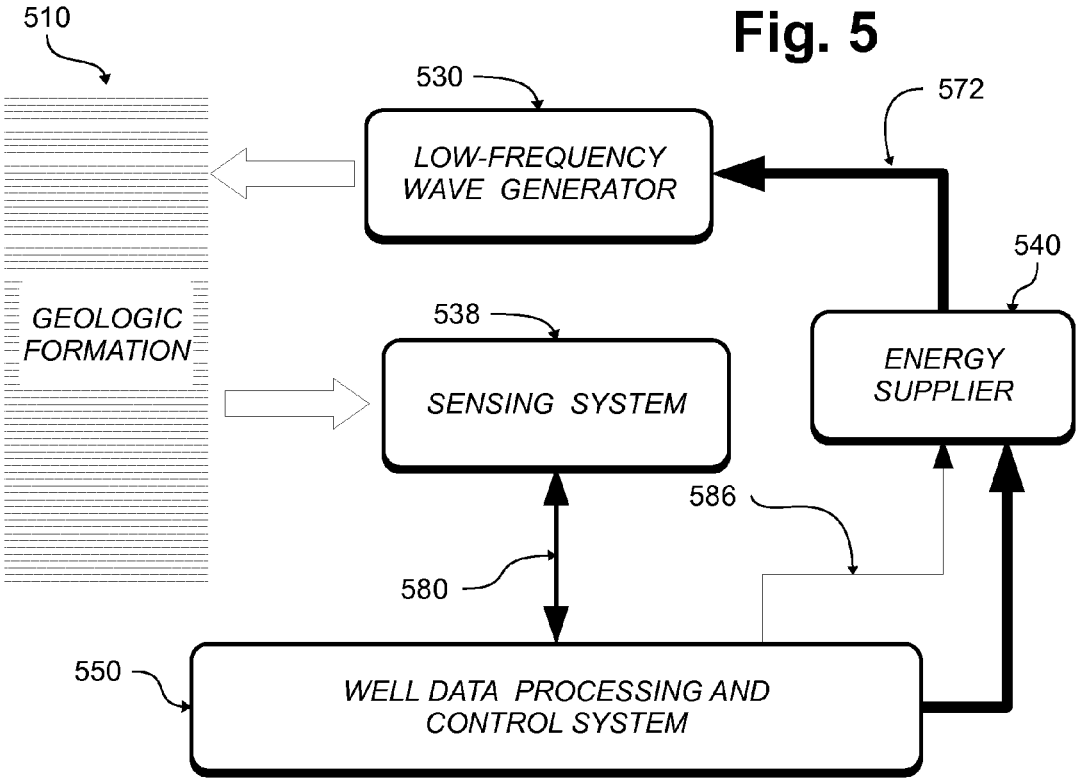
FIG. 5 is a block diagram representing components for stimulating wells in accordance with an embodiment of the invention.

FIG. 5 is a block diagram representing components for stimulating wells in accordance with an embodiment of the invention. The most important factor in recovering a natural resource, such as oil, gas or water, is the geologic formation 510 in which the natural resource resides. The content in minerals, texture compaction are among the physical factors that characterize the geologic formation. When stimulating a well, one has to also take into account the characteristics of the resource itself. For example, oil may greatly differ in its chemical composition and gas content from one well to another within the same reservoir, even as the geologic formation remains similar. The latter is taken into account when selecting the methods by which a well should be stimulated.

Embodiments of the invention provide a tool (e.g., 100) that may comprise one or more components for applying several different stimulation regimens using mechanical waves, applying one of more treatments such as high-pressure water blasting, and collecting information from the well in order to assess the result of the stimulation and re-adjust the treatment parameters.

As described above, the system comprises a tool of a downhole type (e.g., 100). The tool comprises a plurality of devices comprising one or more low-frequency acoustic wave generators (e.g., 530), one or more power generators 540, and one or more sensing devices 538. In addition, a system embodying the invention comprises a data processing and control system 550. The data processing and control system is comprised of a one or more computers. A computer (e.g., of the personal computer type or server) may be any computing device equipped with a processor, memory, data storage system, capable of executing software instructions. The computer for implementing the invention may be enabled with electronic interfaces for communication with other computers and other devices such as analog and digital networking switches, telephones lines, wireless communication, and any other device capable of receiving, processing and/or transmitting data.

The data processing and control system 550 provides a user interface that allows a user to interact with data processing and control. During operation, the acoustic treatment of a well results in changes that affect the geologic formation 510. The latter changes may be reflected in one or more physical parameters such as temperature, pressure, acidity of the water, flow rate of natural resource, gas content or any other parameter that may be measured with a sensor placed in the sensing system. Other types of information are not directly reflected in the measured parameters, but through data processing a user may be enabled with the expertise to interpret the result of the data processing and make decision for further treatments accordingly. For example, after collecting the data over a period of time, the manager may learn from the result of the processed data that a given trend is taking place, upon which, the user may make a decision to increase or decrease the power and/or the frequency of the discharge pulses.

The data processing and control system may provide the energy necessary to supply the energy supplier 540. A power cable (e.g., 570) is typically lowered into the well along with the downhole tool. The control system may deliver the power, for example, in a raw form such as direct-current power or as modulated electrical power that directly controls the downhole device. In the case where the power is delivered to the power supplier, the control system may simply communicate commands to the power supplier. Communication is established through communication means 586 which may be wires, fiber optic cables or other means selected to implement the invention. The commands from the control system to the power supplier may include instructions that determine the driving power the power supplier delivers to any of the devices such as the acoustic wave generators or the sensing system. For example, the data processing and control system allows a manager to preset the periodicity at which a low-frequency acoustic wave generator should operate.

The power supplier 540 comprises a plurality of electronic circuits each of which may be designed to drive an individual component. For example, power supplier 540 may generate high-voltage pulses that drive (e.g., 572) the low-frequency acoustic wave generators; power supplier 540 may generate the power necessary to drive other devices (e.g., heating system) for carrying out one or more treatments to stimulate the well.

The data processing and control system may connect with the sensing system in order to collect data through communication means 580. The sensing system enables embodiments of the invention to collect data in real-time. Since the downhole tool may be permanently installed in the wells (as described above), using embodiments of the invention allows for treating a well while simultaneously collecting data and following the progress of the treatment.

Figure 6:
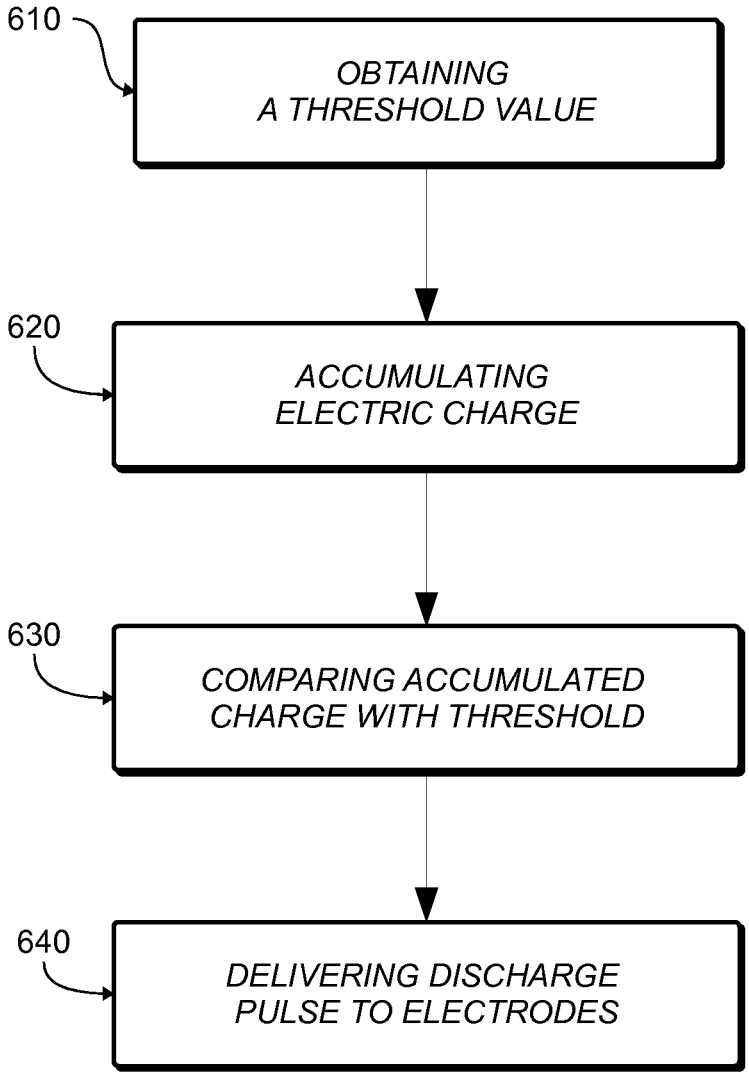
FIG. 6 is a flowchart diagram representing steps involved in applying a mechanical wave discharge delivered to a geological formation in accordance with one embodiment of the invention.

FIG. 6 is a flowchart diagram representing steps involved in applying a mechanical wave discharge delivered to a geological formation in accordance with one embodiment of the invention. At step 610, a system embodying the invention may receive a set threshold used to trigger the pulse discharge into the electrodes. A user may use the user interface provided by the invention to input a threshold and/or alternatively a default threshold may be built in the electronic circuits that drive the wave-generating device. The threshold may be set to determine the voltage at which the discharge is triggered, which may also determine the periodicity at which the discharge is triggered.

At step 620, a system implementing the invention accumulates power in the electric charge-storing device (e.g., one or more high capacity capacitors). At step 620, the system connects electric power from a power source to the electric charge-storing device. At step 630, a system implementing the invention constantly compares the level of charge with the set threshold. The system may determine, based on the reached threshold and user input for discharge, whether to deliver the power to the electrodes. If a determination is made to deliver the electric power to the electrodes, at step 640, the electronic circuits of the power supplier deliver a high-power pulse discharge to the electrodes, thus causing an explosion triggering the mechanical waves that spread through the geological formation.

Figure 7:
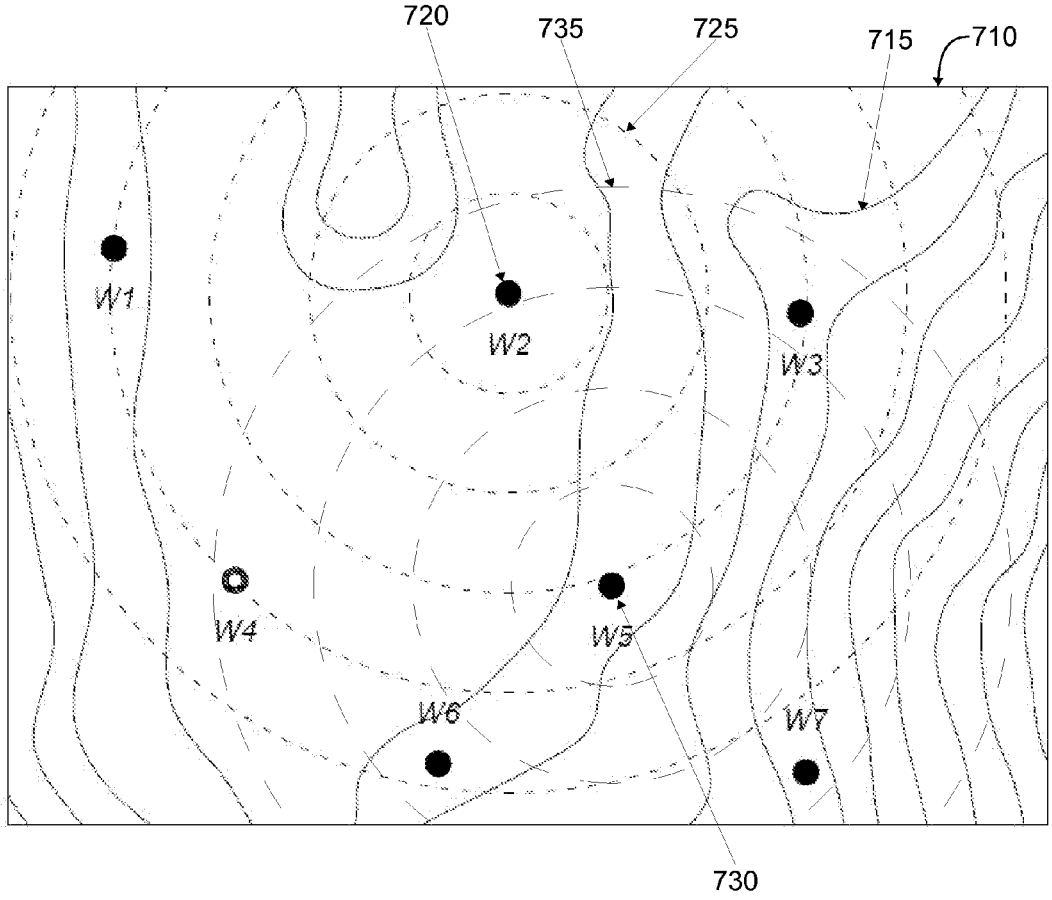
FIG. 7 is a schematic representation of a production oil field having a plurality of wells, where one or more wells are equipped with a system embodying the invention.

FIG. 7 is a schematic representation of a production oil field having a plurality of wells, where one or more wells are equipped with a system embodying the invention. A typical oil field (e.g., 710) hosts a plurality of wells (e.g., W1, W2, W3, W4, W5, W6 and W7). A device embodying the invention may be installed in one or more wells (e.g., 720 and 730) to deliver low-frequency stimulation to the reservoir. The oil field map 710 shows isopach lines (e.g., 715) that represent regions of equal thickness of a geological layer, which may be the layer that contains the natural resource of interest or any other layer above or below the layer of interest. A reservoir manager may utilize the topographical data to select one or more wells for installing a low-frequency well stimulation device embodying the invention. In the example schematically depicted in FIG. 7, wells 720 and 730 are equipped with a device for stimulation a well using low-frequency acoustic waves. As stated above, low-frequency waves tend to travel over long distances. The range of propagation 725 from stimulation device in well 720 may overlap with the range of propagation 735 from stimulation device in a different well (e.g., 730).

In addition to the selection of which particular well (or wells) may be used to stimulate production in a reservoir, the selection of the regime of low-frequency acoustic waves application may be important. For example, even though low-frequency acoustic wave application may increase productivity of a given well, intermittently applying the mechanical waves may prove more beneficial for production than a continuous application. The invention allows for modifying the periodicity by which the mechanical waves are applied in order to find a range time patterns of stimulation that optimize production.

Thus a method, device and system for generating low-frequency mechanical waves that are propagated within and in the vicinity of a production well in a natural resource-producing geological formation in order to enhance the flow of the natural resource from the geological formation toward the well for collection.

The claimed invention is:

1. An Apparatus for stimulating a well producing a natural resource comprising:

a low-frequency mechanical waves generator having a pair of electrodes within a chamber, wherein said mechanical waves generator generates at least one elastic wave having a wavelength of between 1 meters and 3000 meters, and wherein said chamber further having a cylindrical shape wherein the length of said chamber is between half the wavelength of said at least one elastic wave and an integer multiple of the wavelength of said at least one elastic wave;

a deflector for changing the direction of at least a portion of said at least one elastic wave; and a power supplier comprising an electric storage device for storing an electric charge, and a comparator for comparing the electric charge level of said electric storage device with a set threshold.

2. The Apparatus of claim 1 further comprising an electronic circuit for selecting said set threshold.

3. The apparatus of claim 2 further comprising a user interface for receiving user input.

4. The apparatus of claim 1, wherein said chamber is filled with a heat-dissipating liquid.

5. The apparatus of claim 4, wherein said heat-dissipating liquid is an electric conductor.

6. The apparatus of claim 4, wherein said heat-dissipating liquid is electric non-conductive.

7. The apparatus of claim 1, wherein said chamber is made of an corrosion-resistant material.

8. The apparatus of claim 1, wherein said electric storage device further comprising a high-voltage low-impedance capacitor.

9. The apparatus of claim 1, wherein said power supplier further comprises at least one transformer for converting direct electric current to alternative electric current.

10. The apparatus of claim 1, wherein said power supplier further comprising a switching device for delivering said electric charge to said pair of electrodes.

11. The apparatus of claim 10, wherein said switching device and said comparator are further configured to continuously deliver a periodic pulse discharge to said pair of electrodes.

12. A method of enhancing mobility of a natural resource toward a well for producing the natural resource comprising the steps of:

obtaining an electrical circuit for storing an electric charge, and delivering said electric charge to a pair of electrodes placed inside a resonance chamber;

obtaining a threshold for triggering said delivering said electric charge;

comparing a level of said electric charge to said threshold; and switching from a charging state to said delivering said electric charge when said level of said electric charge reaches said threshold, thus generating at least one elastic wave having a wavelength of between 1 meters and 3000 meters, wherein said resonance chamber having a cylindrical shape wherein the length of said resonance chamber is between half the wavelength of said at least one elastic wave and an integer multiple of the wavelength of said at least one elastic wave.

13. The method of claim 12, wherein said obtaining said electrical circuit further comprising obtaining at least one high-voltage and low-impedance capacitor.

14. The method of claim 12, wherein said step of obtaining said threshold further comprising obtaining a default value for said threshold.

15. The method of claim 12, wherein said step obtaining said threshold further comprising obtaining a user input value for said threshold.

16. The method of claim 12 further comprising raising the charge level of said electric charge while the said level is below said threshold level.

17. The method of claim 12 further comprising automatically periodically applying a pulse discharge to said pair of electrodes.

* * * * *